US005311834A

United States Patent [19]

Ross

[11] Patent Number: 5,311,834

[45] Date of Patent: May 17, 1994

[54] INDICATING DEVICE

[76] Inventor: Gregory E. Ross, 2007 Long Leaf Crt., Santa Rosa, Calif. 95403

[21] Appl. No.: 787,314

[22] Filed: Oct. 30, 1991

Related U.S. Application Data

[63] Continuation of Ser. No. 703,420, May 21, 1991, abandoned.

[51] Int. Cl.[5] ..... G09F 9/00; B42D 9/00

[52] U.S. Cl. ..... 116/306; 116/234; 116/308

[58] Field of Search ..... 116/222, 234, 238, 239, 116/270, 306, 307, 308, DIG. 8; 281/42

[56] References Cited

U.S. PATENT DOCUMENTS

| | | | |
|---|---|---|---|
| 168,395 | 10/1875 | Harris | 116/234 X |
| 4,045,013 | 8/1977 | Coster | 116/222 X |
| 4,286,603 | 9/1981 | Marshall | 116/270 X |
| 4,498,668 | 2/1985 | Bowen | 116/324 X |

*Primary Examiner*—William A. Cuchlinski, Jr.
*Assistant Examiner*—W. Morris Worth

[57] ABSTRACT

A numerical device (10) for recording and display of individual numbers, symbols and other indicia. The display can incorporate an infinite number of indicia in rows, columns and the like to represent thousands, hundreds, tens, and single digits and the like. The normal length of each column would be up to a maximum of ten numbers. The numerals are encapsulated in a plastic containment housing (12) having chambers which contain a fluid. By depressing a particular number at a particular location, the fluid is displaced from that location and the contrasting color at the rear of the liquid containment area becomes visible after the opaque liquid has been displaced from that particular location. Each column of numbers, e.g., tens, hundreds etc. would be separately contained on, or adjacent to, one common fluid access compartment. Adjacent numeral chambers are joined by a connecting tube (32). The device (10) would normally be overcovered with an overlay membrane-(54) of paper or the like. A common use for the product is a book mark on the covers of books. The user presses the prospective numbers according to the number of pages that the reader is currently located at and each pressure of the finger displaces the fluid from a particular number in each column.

42 Claims, 3 Drawing Sheets

INDICATING DEVICE

This is a division of Ser. No. 07/703,420, filed May 21, 1991, now abandoned.

BACKGROUND

1. Field of Invention

This invention relates to improvements in book marks and other devices distinguished by numerical or symbol differences and, more particularly, to an improved book marking unit for the pages of a book.

2. DESCRIPTION OF PRIOR ART

Numerous type of bookmarks have been used in the past to indicate the last page of a book which has been read when the reading of the book is to be divided into periods. For the most part, bookmarks are made of a single sheet of cardboard or heavy duty paper for insertion into the book at the location of the last portion to be read. Other techniques for marking a book have been to dog-ear a page by folding it over at the upper corner thereof to indicate the last page of reading by the reader.

While book marks of conventional design are adequate for most purposes, improvements are desirable in this field for one or more reasons. For instance, paper or cardboard bookmarks have a tendency to fall out of the book and the last place where reading stops is lost. Moreover, it is not desired to cause dog-ears to be formed on pages of the book especially if the book is to be saved over a long period of time in a clean condition. Because of these drawbacks, a need exists for improvements in indicating devices which are suitable for use as bookmarks and other such symbol indicating means. The present invention satisfies this need.

SUMMARY OF THE INVENTION

The present invention provides an improved indicating device which has a number of uses including the use as a book mark. The invention includes a member having the plurality of chambers interconnected by tubes, and the member is closed to the atmosphere and contains a fluid which is movable from chamber to chamber through the tubes when the chambers are depressed one by one. For instance, when one of the depressable walls of the chamber is depressed, fluid will flow out of that chamber, through the adjacent tubes and into the other chambers. The chambers are all of approximately equal volume and the tubes have volumes which are approximately equal to each other. The volume of the fluid is substantially equal to the combined volumes of the tubes and the chambers minus the volume of one of the chambers. Thus, when one of the chambers is forced downwardly and depressed, the fluid flows out of that chamber and into the adjacent chamber or chambers, substantially or filling the adjacent chambers and also filling the adjacent tubes so that there is always one chamber which is substantially devoid of fluid. The fluid is chosen so that the surface tension of the fluid is sufficient to prevent flow of fluid in the member until the wall means of the chamber is depressed. To this end, the tubes themselves can be capillary tubes to limit the flow of fluid in the member until one of the chambers is depressed.

Typically, the device, when used as a book mark, is comprised of three members which are arranged vertically on the back or the front of the book in some suitable fashion. The members will be in a column with one column representing the hundreds pages, the second column representing the tens pages and the third column representing single digit pages. Thus, any one of a total number of 999 pages can be marked with the number device having three columns. For a book having more than a thousand pages, a fourth column will be used to represent the thousands numbers.

The member has means to indicate the absence of fluid in a particular chamber. Such means could be a different color on the bottom or inner surface of the chamber, or it could have a numeral or other symbol on the bottom of the chamber which would be observable when the fluid has been substantially purged from the chamber. At any rate, when three members are side by side or in adjacent columns and if numbers are used, the numbers in each member will be observable and these numbers will represent a particular condition of the book, such as the number of pages that have been read or the page which was last read by the reader.

Another use of the present invention is to provide a chord indicator for a guitar, whereby a set of strings to be strummed by a guitarist will be indicated by placing the device made up of three or four columns adjacent to the neck of the guitar in alignment with the frets which are to be fingered to play the chord. This chord arrangement of numbers or symbols can be quickly and easily changed by depressing the yieldable outer walls of the necessary chambers and chords will be more quickly learned than if the chords are played without the device of the present invention.

The primary object of the present invention is to provide an improved numerical indicator device for utilitarian use where the device includes a member closed to the atmosphere and containing a plurality of chambers for containing a fluid moveable chamber to chamber through connecting tubes, whereby the depressing of one of the chambers causes fluid to flow to the other chambers, leaving the one chamber substantially void of fluid and having an indicating symbol representing a particular condition, such as the number of pages in a book having been read to thereby provide an indicator of the present condition of a situation which can be apparent at a glance.

Another object of the present invention is to provide a bookmarking device which allows the reader of a book to operate the device to indicate the page on which the reader stops reading and is to take up reading at the next sitting to thereby eliminate the need for conventional bookmarking devices and techniques and thereby provide an improved bookmarker which is simple in construction, can be attached directly to a book or loosely held therein. Other objects of this invention will become apparent as the following specification progresses, reference being had to the accompanying drawings for an illustration of the invention.

BRIEF DESCRIPTION OF THE DRAWINGS

FIG. 4 is a perspective view of the device showing the way in which three columns of elements or members are coupled by a card to a book cover or the like;

DESCRIPTION OF THE PREFERRED EMBODIMENT

Figure 1:
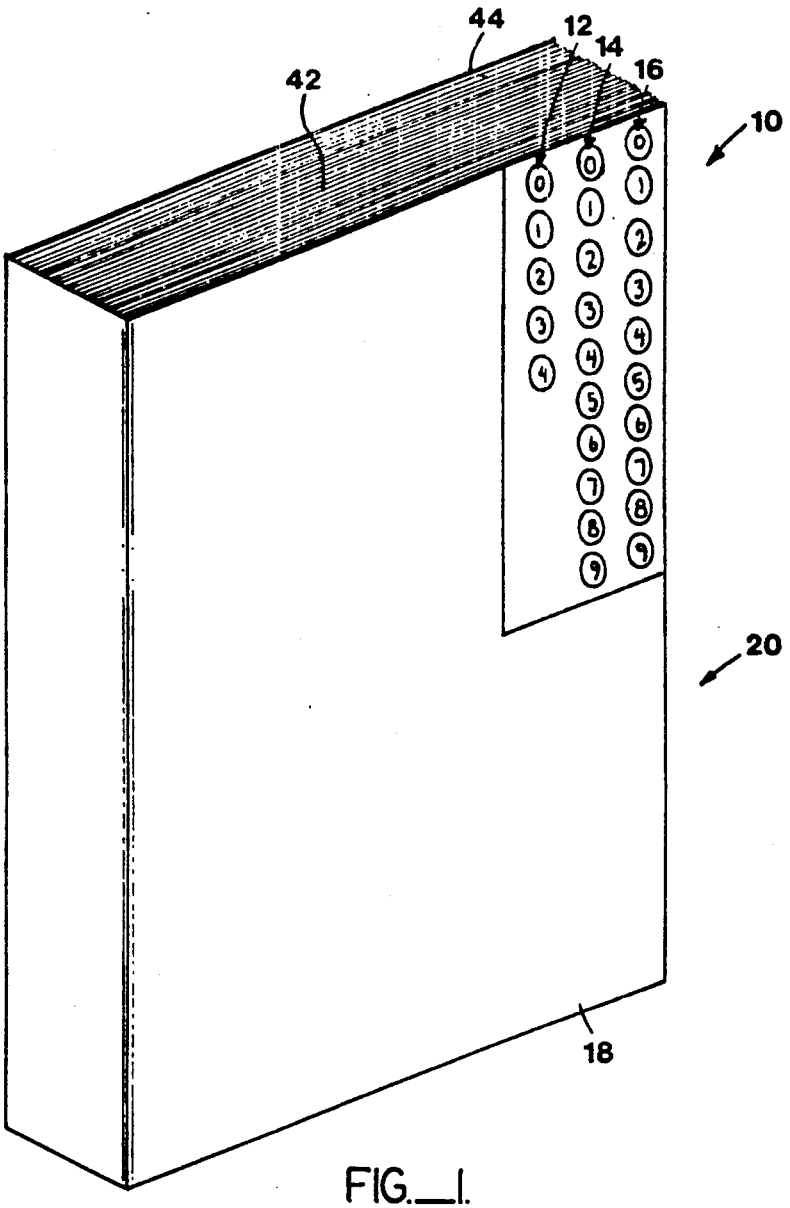
FIG. 1 is a perspective view of a preferred embodiment of the device of the present invention showing a book on which the device is used.

While the present invention is suitable for a number of different uses for indicating numerals or symbols, it is especially suitable for use as a bookmarker. To this end, the device of the present invention is broadly denoted by the numeral 10 and includes a plurality of members 12, 14 and 16 arranged in columns as shown in FIG. 1 on the front cover of a book 20 having a plurality of pages 42 and a rear cover 44. Members 12, 14 and 16 have observable indicia, symbols or numbers which represent the particular numbers of pages of a book which have been read or indicate the last page of a book which has been read at a particular sitting. When the book is next taken up for reading, the person merely glances at the number exposed by members 12, 14 and 16 and knows exactly where to turn to in the book to take up reading once again.

For instance, if the numbers 2, 4, and 8 were to be observable by looking at device 10, the reader will know that he is to start reading again at page 248 because that is the page where he last left off reading when the book was taken up at the last sitting. At any one time, only a single number will be visible for each member 12, 14 and 16.

Figure 2A:
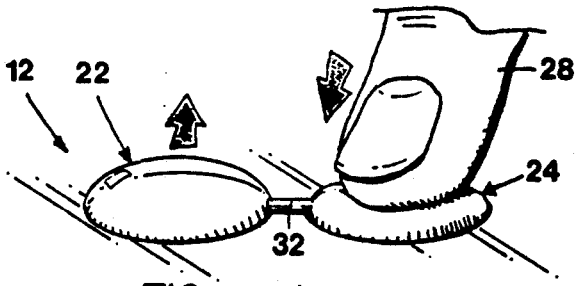
FIG. 2A is a perspective view of a portion of the device showing the way in which one element of the device is depressed by a finger to force liquid out of the chamber of the element and into an adjacent chamber of the element.
Figure 2B:
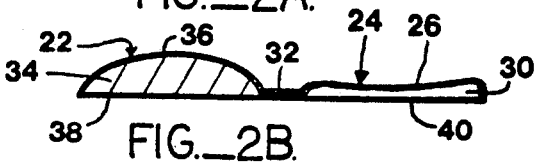
FIG. 2B is a vertical section through the two-element member of FIG. 2A.

FIGS. 2A and 2B indicate the basic operating principle of the present invention. To this end, member 12 will be considered in FIGS. 2A and 2B which show only two elements of member 12 since only two are necessary to illustrate the basic concept of the present invention.

Member 12 is comprised of at least two elements or hollow stations 22 and 24 which are formed from a suitable yieldable material, such as a plastic or the like. Elements 22 are hollow as shown in FIG. 2B and element 24 has its upper yieldable, dome-shaped top wall 26 depressed by a finger 28 so that approximately all of the liquid or fluid in chamber 30 of element 24 will be forced through a small tube 32 into chamber 34 of element 22 which also has a dome-shaped top wall 36. The fluid can be a flowable material which is solid or liquid. Typically it is liquid, but it is contemplated that a crystalline, particulate flowable material could be used for the same purpose. Moreover, the top yieldable walls 26 and 36 of elements 22 and 24 can be transparent or translucent so that the color of the material fluid can be quickly seen and if there is no color in chamber 30, this means that there is almost no fluid in the chamber then it is the chamber which is to be indicated. Furthermore, the yieldable and base walls 38 and 40 of elements 22 and 24 can have numbers on the upper surfaces thereof and these numbers will be viewable to the observer when almost no fluid is in a particular chamber. The numbers could also be exterior to the elements, such as on a card or surface adjacent to the device.

The fluid in the chambers can have a surface tension which is sufficient to prevent flow of the fluid out of element 22 back into element 24 through tube 32 until the wall means 36 of element 22 is depressed. To this end, tube 32 could be a capillary tube which would prevent normal flow of fluid back into chamber 30 of element 24 until pressure is applied to the yieldable top wall 36 of element 22.

Figure 3:
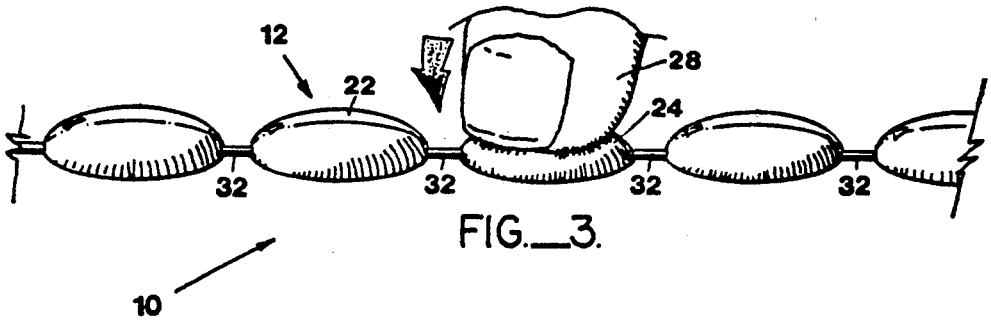
FIG. 3 is a view similar to view 2A but showing a greater number of elements connected together with one of the elements being depressed by the finger to operate the device.

FIG. 3 shows a series of five elements having internal chambers connected together by tubes 32. The top wall of the middle chamber is being depressed by the finger so that fluid can flow in opposed directions through the two tubes 32 connected to the middle chamber and into the chambers on opposite sides of the middle chamber. Once the chamber is depressed, it will remain depressed as shown in FIG. 2B until the next depression of a chamber yieldable wall, such as wall 26 of element 24 (FIG. 2B).

The chambers of the device are all of approximately equal volume, and the tubes 32 have volumes which are approximately equal to each other. The volume of the fluid in the chambers is substantially equal to the combined volumes of the chambers and tubes minus the volume of one of the chambers. Thus, there is always one chamber devoid of fluid.

In use, members 12, 14 and 16 are carried by a card 50 (FIG. 4) and the members are secured to the surface 52 of a book, such as a back cover or front cover 18 of the book shown in FIG. 1. The elements of members 12, 14 and 16 are arranged in columns and the book is considered to have less than 500 pages.

Figure 5:
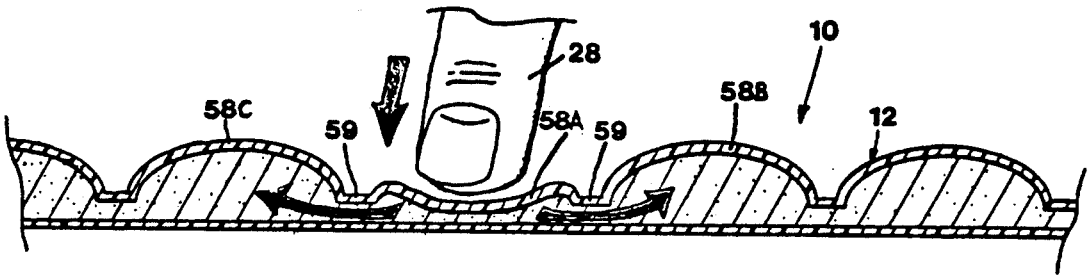
FIG. 5 is a view similar to FIG. 2B but showing the way in which fluid is forced out of the chamber of one of the elements into the chambers of adjacent elements.

Once upper cover 54 is placed on backing 52 and sealed, such as by glue or the like, the holes 56 in cover 54 will overlie the particular elements, such as indicated by the numeral 58 and these elements will project through holes 56 and be depressable so as to force fluid out of a particular chamber and into the adjacent chambers. FIG. 5 shows how fluid will be forced out of a chamber 58A and into adjacent chambers 58B through connecting tubes 59. The fluid in chamber 58C and 58B is indicated as being in cross hatched form with the fluid being essentially emptied out of the chamber associated with element 58A and the arrows indicating the direction of the fluid flow out of the chamber 58A into the adjacent chambers. Since the fluid is such that the fluid will not return to element 58A until another element is depressed, element 58A will remain empty and will remain depressed until the next element of the member is depressed.

Figure 4:
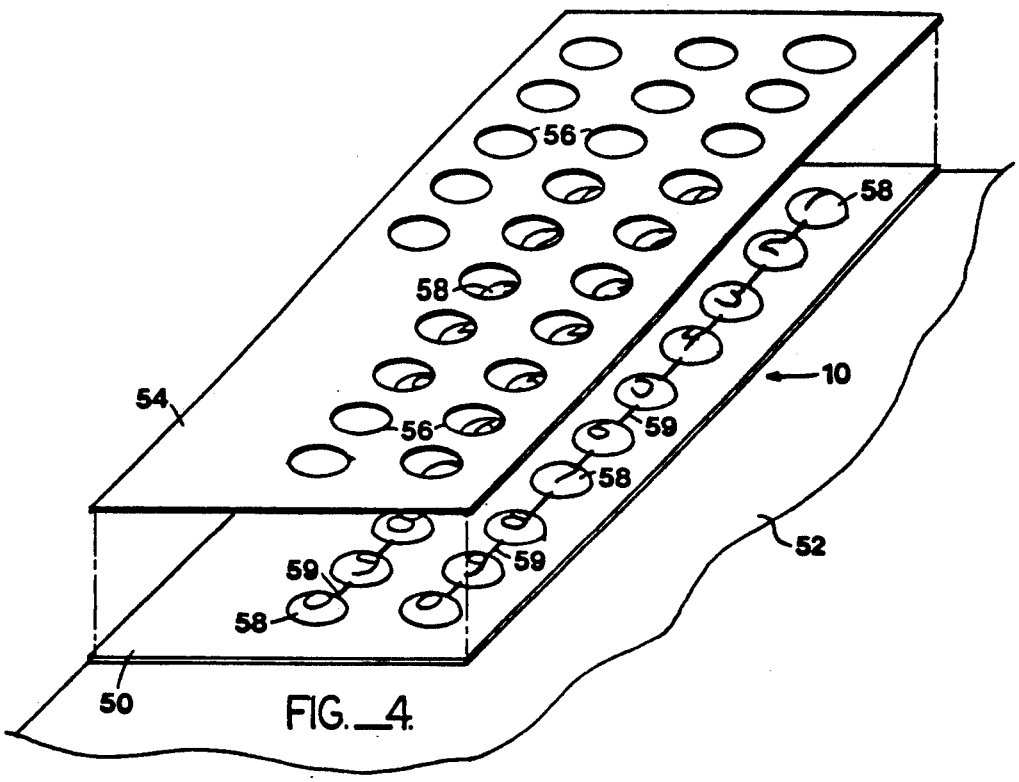

In view of the foregoing, it is clear that by depressing a yieldable top wall of an element in each of the three columns of FIG. 4, three indicia, symbols or numerals will be observable and these indicia, symbols or numerals will indicate a certain condition, such as the number of pages of a book which have been read or the page number which is to be taken up at the next sitting in which the book is read. An indicator of some such sort such as a number on the base of an element can be viewed to indicate the substantial absence of fluid in the particular chamber and these observable numbers will be seen through the transparent or translucent top dome-shaped yieldable walls of the elements, such as elements 58A, 58B and 58C.

The shapes of the chambers could be different from each other to provide indicia or symbols which convey information of different types. The chambers could be polygonal as well as dome-shaped as shown.

The device can be used for other purposes as well. For instance, it can be used to teach the chords of a guitar by providing a card-shaped device with three or more columns of numerals or symbols. The symbols and numerals can be indicated by depressing the yieldable walls thereof so as to indicate the frets to be fingered when playing a particular chord by the guitarist.

Figure 6:
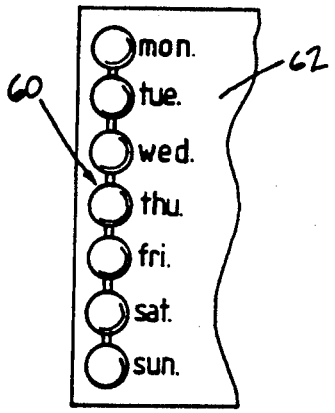
FIG. 6 is a top plan view of a device of the present invention for selectively indicating one day of the week.

The device can be used to selectively indicate a day of the week as shown in FIG. 6. Each chamber of a single column of chambers of a member 60 is assigned a particular day of the week and is so marked on a card or base 62 to which member 60 is secured.

Figure 7:
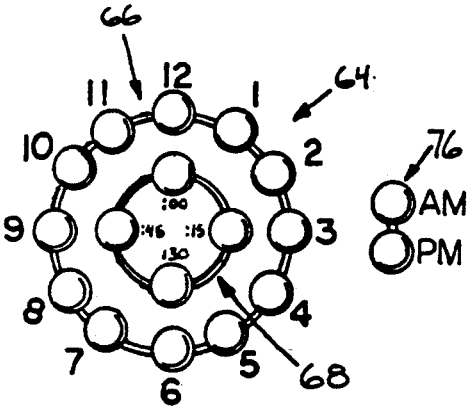
FIG. 7 is a top plan view of a device of the present invention for indicating time of day for use as a reminder for appointments, and taking medication, etc.

The devices of FIGS. 7–11 can be used to show different configurations and applications of the present invention. FIG. 7 shows a device 64 having a first circular member 66 of twelve chambers and a second circular member 68 of four chambers, member 68 being within member 66. A two-chamber member 70 is adjacent to member 66. The chambers of member 66 represent the hours of a half-day, the chambers of member 68 represent the quarter hours, and the chambers of member 70 represent a.m. and p.m. A device of FIG. 7 is suitable for use in timing medication dosage, and the device can be used as a reminder as to when a medicine is to be taken or has been taken previously.

Figure 8:
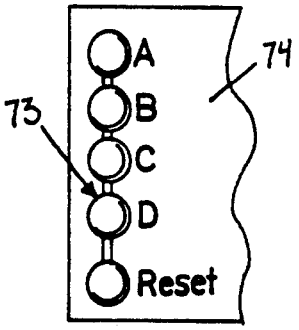
FIGS. 8 and 9 are views similar to FIGS. 6 and 7 but showing a pair of devices for playing a game, FIG. 8 showing the device for providing multiple choice questions and FIG. 9 showing the device for providing answers or responses.

FIG. 8 represents a device 72 which can be used for playing a game, such a child's game using multiple choice questions. The elements A, B, C and D and the reset elements of a five-chamber member 73 are all arranged on a card 74 so as to be different colors and provide the basis for questions for playing the game.

Figure 9:
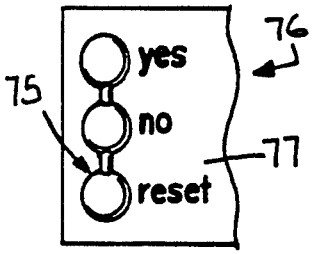

FIG. 9 shows a device 76 made up of a three-chamber member 75 on a card 77 which provides the means for answering or responding to the questions raised by the use of the device of FIG. 8.

Figure 10:
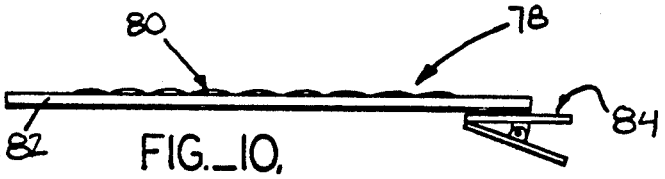
FIG. 10 is a side elevational view of another embodiment of the device of the present invention, showing the device mounted on a panel and a chip mounted on a panel for attaching the device to a structure.

FIG. 10 shows a device 78 which includes a ten-chamber member 80 mounted on a panel 82. A clip 84 at one end of panel 82 is for attaching the device 78 to the clothing or to a wall or other structure. The clip could be a magnet or an adhesive.

Figure 11:
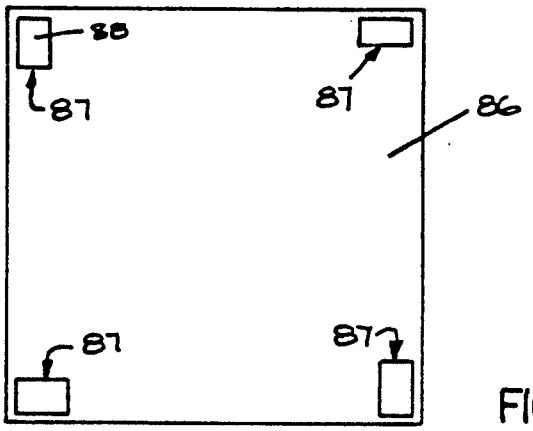
FIG. 11 is a plan view of a child's game showing the device in a corner of the game board for keeping score.

FIG. 11 is a plan view of a game board 86 for playing a child's game showing the device 87 in four corners of the board for keeping score. The device has a member 88 with a number of chambers.

The device of the present invention could also be made waterproof so as to stick onto boats and other watercraft to assist, for instance, in scheduling and accounting for the presence of rental boats in a rental agency. The waterproofing of the device can also be suitable to make score pads as well. The invention can be a device printed with braille adjacent to the chambers of the device for use by the blind.

I claim:

1. A indicia indicating device comprising: an elongated member closed to the atmosphere and having a plurality of spaced serially connected chambers, each pair of adjacent chambers having a tube therebetween for placing the chambers in fluid communication with each other; and a fluid within the member and moveable relative to the chambers and tubes when a pressure is exerted on the fluid, said member having a depressable wall for each chamber, respectively, the volume of the fluid being substantially equal to the combined volumes of the tubes and the chambers minus the volume of one chamber, whereby the fluid in a filled chamber can be forced into the adjacent chambers and tubes by depressing said wall of the filled chamber, the fluid having a characteristic sufficient to prevent flow of fluid in the member until the wall of a selected, filled chamber is depressed, said member having means to indicate at least partial removal of the fluid from the selected chamber.

2. An indicating device as set forth in claim 1, wherein said fluid includes a quantity of liquid.

3. An indicating device as set forth in claim 1, wherein said fluid comprises a flowable solid material.

4. An indicating device as set forth in claim 1, wherein said characteristic is the surface tension of the fluid.

5. An indicating device as set forth in claim 1, wherein each tube includes a capillary tube.

6. An indicating device as set forth in claim 1, wherein the wall of each chamber includes a dome-shaped outer wall, each outer wall being depressible individually to force the fluid out of the respective chamber, through the adjoining tubes, and into the adjacent chambers.

7. An indicating device as set forth in claim 1, wherein each chamber of the member includes a base wall, said base and yieldable walls being coupled together and moveable relative to each other.

8. An indicating device as set forth in claim 7, wherein each yieldable wall is disc-shaped and is coupled to the adjacent base wall at the outer peripheries of the walls.

9. An indicating device as set forth in claim 1, wherein said wall of a chamber has a color different from the color of the fluid in the chamber to present said means to indicate at least the partial removal of fluid in the chamber.

10. An indicating device as set forth in claim 1, wherein each chamber is substantially disc-shaped.

11. An indicating device as set forth in claim 10, wherein said tubes are longitudinally straight.

12. An indicating device as set forth in claim 10, wherein at least one of said tubes is curved.

13. An indicating device as set forth in claim 1, wherein said member is circular.

14. An indicating device as set forth in claim 1, wherein is included a plurality of members adjacent to the elongated member, each of said members having a number of serially connected chambers and a fluid in the members, each chamber having a yieldable wall and an indicia displayed when the chamber is at least partially empty of fluid, whereby the members can be provided in side-by-side relationship to selectively display a multi-unit display.

15. An indicating device as set forth in claim 1, wherein said chambers define a series of disc-shaped fluid receiving elements with the yieldable wall of each chamber being a dome-shaped, depressable outer wall, the fluid force in the chamber being sufficiently less than the force required to return said depressable wall to an undepressed condition after the depressable wall has been depressed.

16. An indicating device as set forth in claim 1, wherein each member has means to secure it to a supporting surface and each chamber having a respective indicia therein which is selectively displayed when the yieldable wall is depressed.

17. An indicating device as set forth in claim 1, wherein said fluid comprises a liquid gel.

18. An indicating device as set forth in claim 1, wherein said yieldable wall is substantially transparent and said fluid in the member comprises a water based material having a coloring agent to provide a visual contrast between the appearance of a chamber approximately full of the material and the appearance of the chamber when said chamber is at least partially empty.

19. An indicating device comprising: an elongated member having a closed chamber, said chamber having a plurality of spaced chamber segments, in serial fluid communication with each other, each chamber segment having a yieldable wall, and a tube interconnecting each pair of chamber segments respectively, there being a fluid in the chamber, said chamber having a space defined by one chamber segment to permit the fluid to be movable relative to the chamber segments when the wall of a selected chamber segment is depressed, and means associated with each chamber segment respectively, for defining indicia indicating the depression of the wall of the selected chamber segment.

20. An indicating device as set forth in claim 19, wherein the indicia for each chamber segment is within the chamber segment, each chamber segment having means permitting the respective indicia to be observed when the chamber segment wall is depressed.

21. An indicating device as set forth in claim 19, wherein the defining means is on an inner surface of the respective chamber segment, the material of each chamber segment being substantially optically transparent to permit the defining means to be observed from a location exteriorly of the chamber segment.

22. An indicating device as set forth in claim 19, wherein each chamber segment has an outer configuration, different from at least one of the other chamber segments.

23. An indicating device as set forth in claim 19, wherein each chamber segment has an outer configuration different from the outer configurations of the other chamber segments.

24. An indicating device as set forth in claim 19, wherein said member is formed from a plastic material.

25. An indicating device as set forth in claim 19, wherein the chamber segments are of approximately equal volume, the combined volume of the fluid being less than the volume of said chamber segments and said tubes.

26. An indicating device as set forth in claim 19, wherein the tubes are of approximately equal volume, the chamber segments being of approximately equal volume, and the volume of the fluid being approximately equal to the combined volumes of the chamber segments and the tubes minus the volume of a single chamber segment.

27. An indicating device as set forth in claim 19, wherein the member is longitudinally straight.

28. An indicating device as set forth in claim 27, wherein is included a flat panel, said member being mounted on one face of the panel, said indicia being on the one face of the panel for respective chamber segments.

29. An indicating device as set forth in claim 19, wherein said member is curved.

30. An indicating device as set forth in claim 19, wherein the member is circular.

31. An indicating device as set forth in claim 30, wherein is included a panel, said member being mounted on one face of the panel, said indicia being on the panel for each chamber segment, respectively.

32. An indicating device as set forth in claim 1, wherein said member has twelve chamber segments arranged in a circle to represent the twelve hours in a half day, there being a second member adjacent to the first-mentioned member, said second member having a closed chamber provided with a pair of chamber segments and a tube interconnecting the pair of chamber segments.

33. An indicating device as set forth in claim 32, wherein is included a panel having a pair of opposed faces, said members being mounted on one face of the panel.

34. An indicating device as set forth in claim 33, wherein said indicia is on said one face of the panel to distinguish the chamber segments of said members from each other.

35. An indicating device as set forth in claim 32, wherein said second member is of circular configuration, said second member closed chamber provided with four chamber segments, said second member being in proximity of the circle formed by the first-mentioned member.

36. An indicating device as set forth in claim 19, wherein the wall of each chamber segment being substantially transparent said indicia being within each chamber segment.

37. An indicating device as set forth in claim 19, wherein said member has a base wall for each chamber segment, respectively, each base wall being coupled to the yieldable wall of the respective chamber segment.

38. An indicating device comprising: means for defining a plurality of hollow chambers and a tube for each pair of adjacent serially connected chambers, respectively, for placing the chambers in serial fluid communication with each other, the chambers and tubes defining a closed space; a fluid in said closed space and movable in the space only when a selected chamber is depressed, said chamber defining means being formed of a yieldable material; and means associated with each chamber, respectively, for indicating when pressure has been applied to the fluid in said selected chamber.

39. An indicating device as set forth in claim 38, wherein said material is a flexible plastic.

40. An indicating device as set forth in claim 38, wherein the indicating means for each chamber includes indicia within the chamber and means permitting the respective indicia to be observed.

41. An indicating device as set forth in claim 38, wherein the chambers are of approximately equal volume, the volume of the fluid being less than the volume of the chambers and tubes.

42. An indicating device as set forth in claim 38, wherein the volume of the fluid is approximately equal to the combined volumes of the chambers and tubes minus the volume of a chamber.

* * * * *